United States Patent [19]

Vandermeirsch

[11] 3,978,689

[45] Sept. 7, 1976

[54] NEEDLE BED FOR FLAT KNITTING MACHINES

[75] Inventor: Marcel A. Vandermeirsch, St. Amandsberg, Belgium

[73] Assignee: Fabrique Nationale Herstal S.A., Liege, Belgium

[22] Filed: Apr. 22, 1975

[21] Appl. No.: 570,365

[30] Foreign Application Priority Data

May 14, 1974 France ..... 74.16669
Dec. 24, 1974 France ..... 74.42703

[52] U.S. Cl. ..... 66/75 R
[51] Int. Cl.[2] ..... D04B 7/00
[58] Field of Search ..... 66/75, 60, 76, 64, 67, 66/70

[56] References Cited

UNITED STATES PATENTS

| | | | |
|---|---|---|---|
| 616,600 | 12/1898 | Burson | 66/66 A |
| 650,376 | 5/1900 | Donner | 66/67 A |
| 819,407 | 5/1906 | Burson | 66/66 A |
| 1,728,661 | 9/1929 | Burson | 66/66 |
| 1,740,618 | 12/1929 | Nelson | 66/75 |
| 1,802,395 | 4/1931 | Rolston | 66/66 A |
| 1,809,063 | 6/1931 | Parker | 66/67 |
| 1,835,518 | 12/1931 | Parker | 66/66 |
| 3,717,014 | 2/1973 | Kohler | 66/75 A |

FOREIGN PATENTS OR APPLICATIONS

| | | | |
|---|---|---|---|
| 1,106,546 | 12/1955 | France | 66/70 |
| 1,048,399 | 11/1966 | United Kingdom | 66/70 |

*Primary Examiner*—Ronald Feldbaum
*Attorney, Agent, or Firm*—Bacon & Thomas

[57] ABSTRACT

Improved needle bed for flat knitting machines of the type having needles with heels which may be sunk within the bed, comprising, for each sunkable needle, an oscillating lever, one bifurcated end of which receiving the tail of the associated needle, while its other end is subjected to the action of a control member which may be reciprocated through the intermediary of selecting means.

14 Claims, 18 Drawing Figures

1
2
3
4
6
7
8
9
11
12
13
14
16
17
19
20
21
22
23
24
25
26
27
28
29
32
33
34
37
39
40
42
43
44
45
46
47
50
51

NEEDLE BED FOR FLAT KNITTING MACHINES

This invention relates to an improved needle bed for flat knitting machines.

More particularly, the invention relates to a needle bed equipped with means allowing to selectively withdraw the needles from the action of the knitting cams, for instance with the view of effecting narrowings with facing stitches, i.e. by maintaining the stitches on the narrowed needles.

The narrowing operation with facing stitches is known for a long time and its principle is adopted in the circular knitting machines having a small diameter.

Heretofore, this operation required the use of Jacquard type flat knitting machines with special Jacquard healds in a number equal to that of the narrowings.

The preparation of said healds is a time consuming and expensive operation all the more as different sets must be provided for each of the intended sizes of the same cloth model.

In addition, the conventional narrowing operation with facing stitches causes plastic deformations which may lead to the rupture of the facing stitches by the narrowed needles. This is due to the action of the knock-over or stitch cams which, during the knitting operation, are imparting a slight return movement to the narrowed needles relative to their rest position. Accordingly, it is not possible to reliably obtain neat selvedges in the narrowed zones.

In order to reduce this fatigue effect, the narrowed needles could be withdrawn from the action of the knitting cams by momentarily sinking the heel thereof within the needle bed.

Needle beds equipped with means allowing the withdrawal are known (see Belgian Pat. No. 682,217). In such needle beds, the needles are under the negative action of a spring. When knitting at a high speed (linear speed of the carriage: about 1.5 m/sec.), the needles would tend to sink under the action of the knitting cams, thereby resulting in unadmissible failures.

Another method for reducing the above-mentioned fatigue effect would consist to slow down the needles in their guiding groove. However, the knitting operation would be thereby difficult, while causing a rapid wear of the concerned parts.

The object of this invention is to provide a needle bed equipped with means for momentarily and individually braking the narrowed needles while allowing an easy selection of the said needles.

For this purpose, a needle bed according to the invention comprises, for each needle being sunk, an oscillating lever one bifurcated end of which receives the tail of the associated needle, while the other end is subjected to the action of a control member which may be reciprocated through a selecting means.

This invention will be described hereafter with more details, reference being made to the enclosed drawings given only by way of example and without any limitation. In said drawings.

Figure 1:
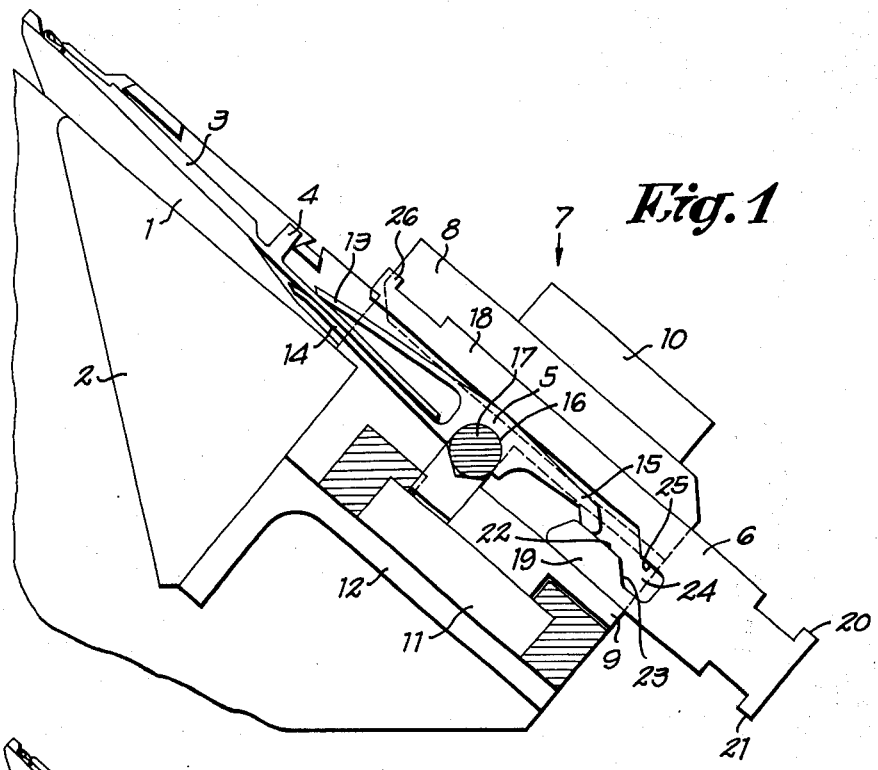
FIG. 1 is a diagrammatic cross section of a head of a flat knitting machine equipped with needle beds according to the invention.
Figure 8:
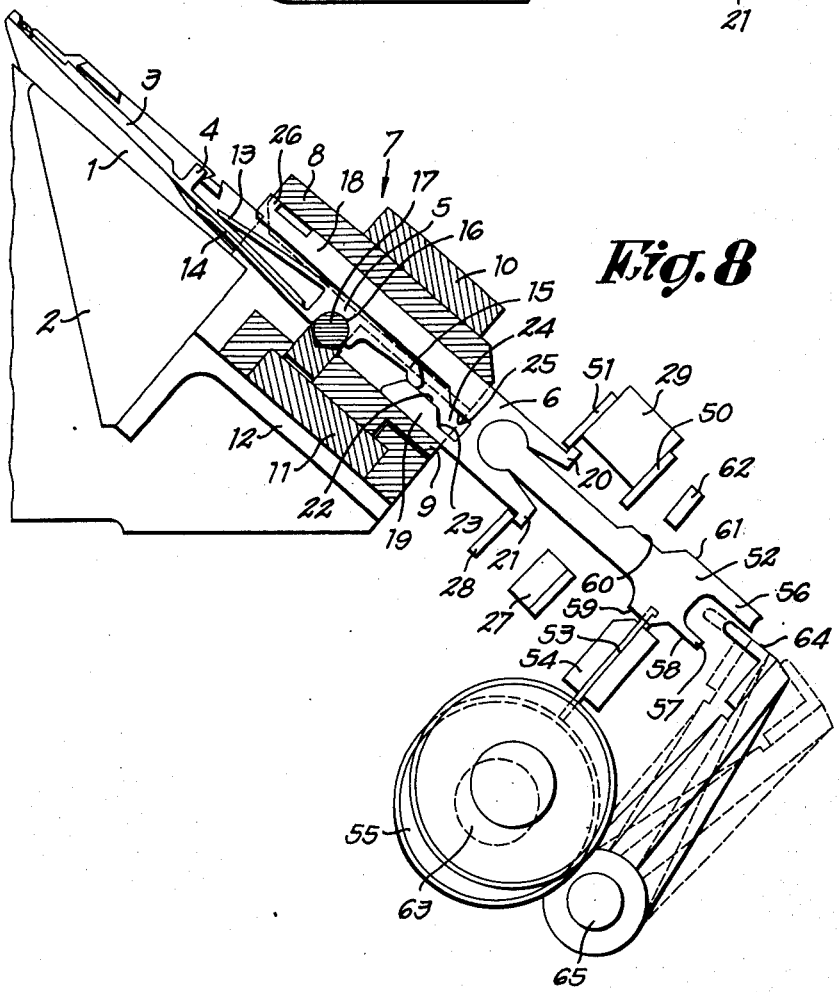
Figure 2:
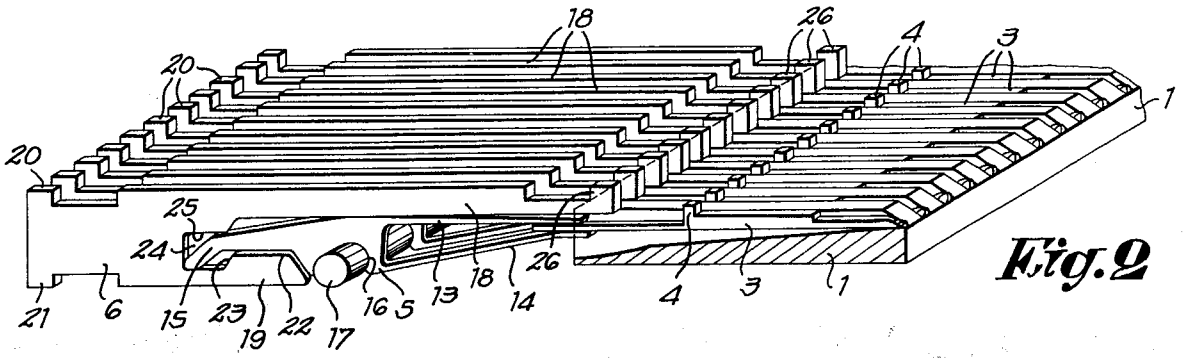
FIG. 2 is a fragmentary perspective view of a needle bed according to the invention.
Figure 7:
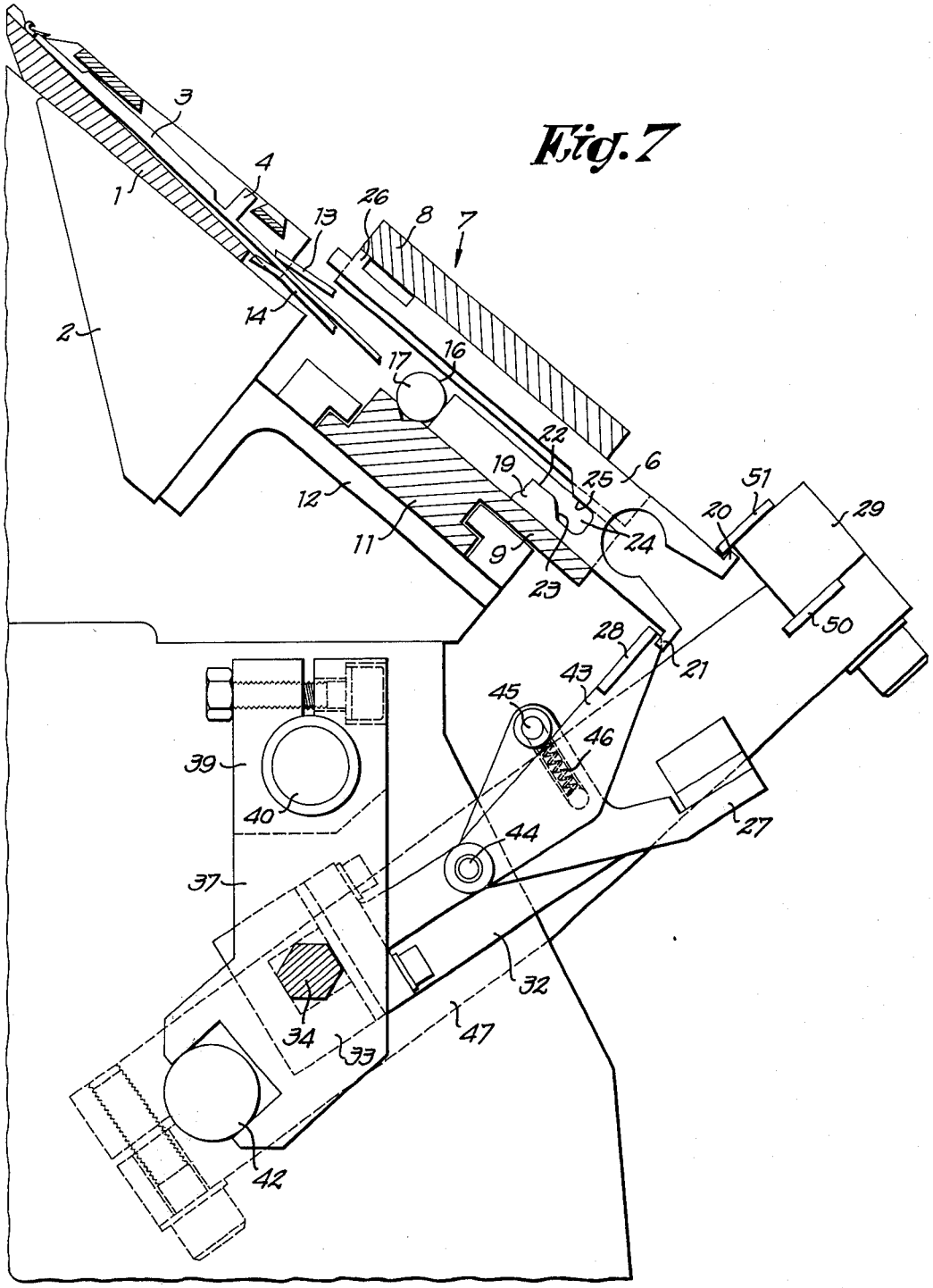

FIG. 7 gives precisions relating to the mounting of the widening and narrowing fingers as well as of the width comb;

FIG. 8 is a view similar to FIG. 1, the needle bed being completed by a Jacquard type selecting device;

FIGS. 9 to 14 show all the possibilities of the selecting device according to FIG. 8.

FIGS. 15 to 18 show another embodiment of the invention in four characteristic positions.

The two needle beds of the head of the machine shown in FIG. 1 being identical, only one of them will be described.

In the represented example, the needle bed comprises a bed of needle 1 provided with a support 2 and containing a plurality of needles 3 having each a heel 4. The bed of needles 1 has such a configuration that, the needles being in a determined position, the heels 4 thereof are sunk. These arrangements are well known.

According to the invention, the upper or sunk position of the heel 4 of each needle 3 is determined by the position of a rocker 5 associated with the said needle and controlled by a selector 6.

The rocker-selector units are housed within a box 7 consisting of guides 8 and 9 confined between flat irons 10 and 11. The box 7 is made integral with the support 2 through the intermediary of one or several squares 12. In fact, the guides 8 and 9 are parts grooved at the gauge of bed 1.

Each rocker 5 has a bifurcated portion with two legs 13 and 14 which are initially converging and then parallel with a bent tail 15 on the opposite side. Near its central portion, the rocker has a semi-circular recess 16 so that it may overlap a rocking axis 17 extending longitudinally within the box 7, said axis 17 being common with all the rockers. The rockers 5 and the needles 3 are so dimensioned that, when they are mounted, the tail of each needle extends at least partially between the legs 13 and 14 of the associated rocker.

Each selector 6 has, on one side, two legs with unequal lengths 18 and 19 respectively and, on the other side, a tail having two opposite heels 20 and 21 respectively.

The edge of leg 19 facing leg 18 is profiled to present a locking flat portion 22, a control ramp 23 and a housing 24. The edge of the leg 18 facing the leg 19 has a projecting flat portion 25 connected with the base of the leg 19 for completing the said housing 24.

Figure 3:
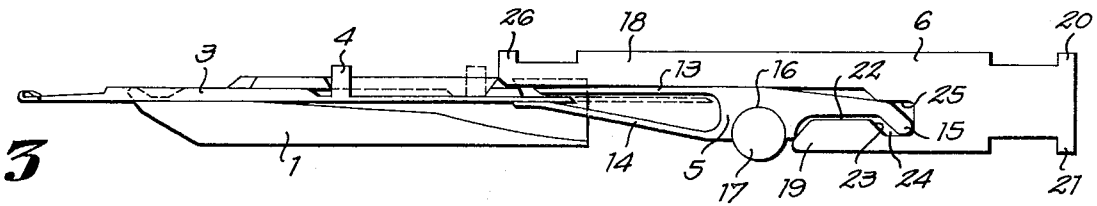
FIGS. 3 to 5 show respectively three characteristic positions of the elements of a needle bed according to FIGS. 1 and 2.
Figure 4:
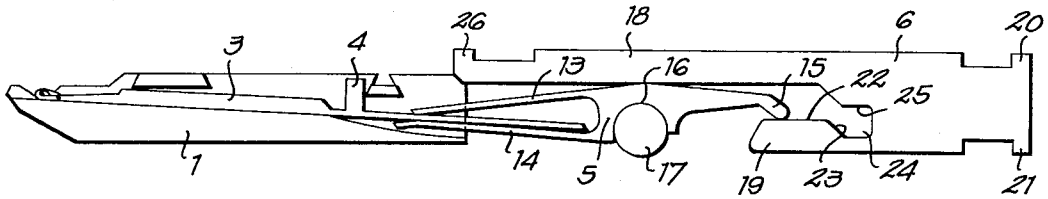
Figure 5:
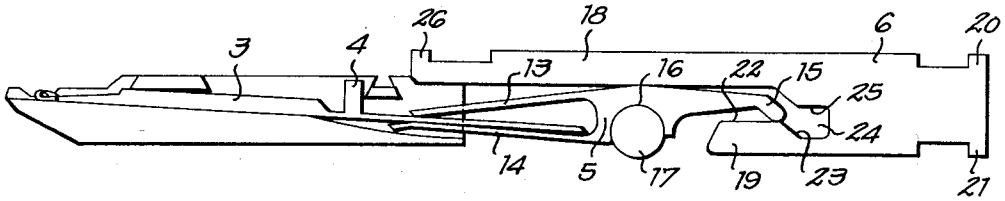

The facing edges of the legs 18 and 19 are profiled as described and they are dimensioned so that the bent tail 15 of a rocker 5 may be introduced completely between the said legs in the plane of FIGS. 3 to 5 only by a combined reciprocating and rotating movement of a part relative to the other.

It is apparent that the position imparted to the selector 6 will determine the angular position of the rocker and, hence, that of the associated needle 3 within the bed 1.

Thus, three characteristic positions of the concerned parts are shown in FIGS. 3 to 5.

In FIG. 3, the selector 6 is completely sent back forwardly; the tail 15 of the rocker 5 engages the housing 24 and the heel 4 of the needle 3 projects on the bed of needles 1 and may be subjected to the action of the conventional cam systems (not shown).

FIG. 4 shows the other end position. When the selector 6 is returned, the control ramp 23 has pivoted the tail 15 of rocker 5 upwardly. The said tail is now locked on the flat portion 22, the rocker being in low position.

The heel 4 of the needle 3 is sunk and thus withdrawn from the action of the cam systems.

As shown in FIG. 5, an intermediate position could be provided, in which the heel 4 is sunk and the tail 15 is also locked on the flat portion 22. Such position could be interesting for increasing the selection possibilities: a heel 26 provided therefor at the free end of the leg 18 would be then disposed on the path of the special selecting cams provided for this purpose on the cam system.

It will be noted that, when the heel 4 is sunk (case of FIGS. 4 and 5), the tail of the needle 3 is clamped between the ends of the legs 13 and 14 of the rocker 5, thereby inducing the above-mentioned temporary braking.

Figure 6:
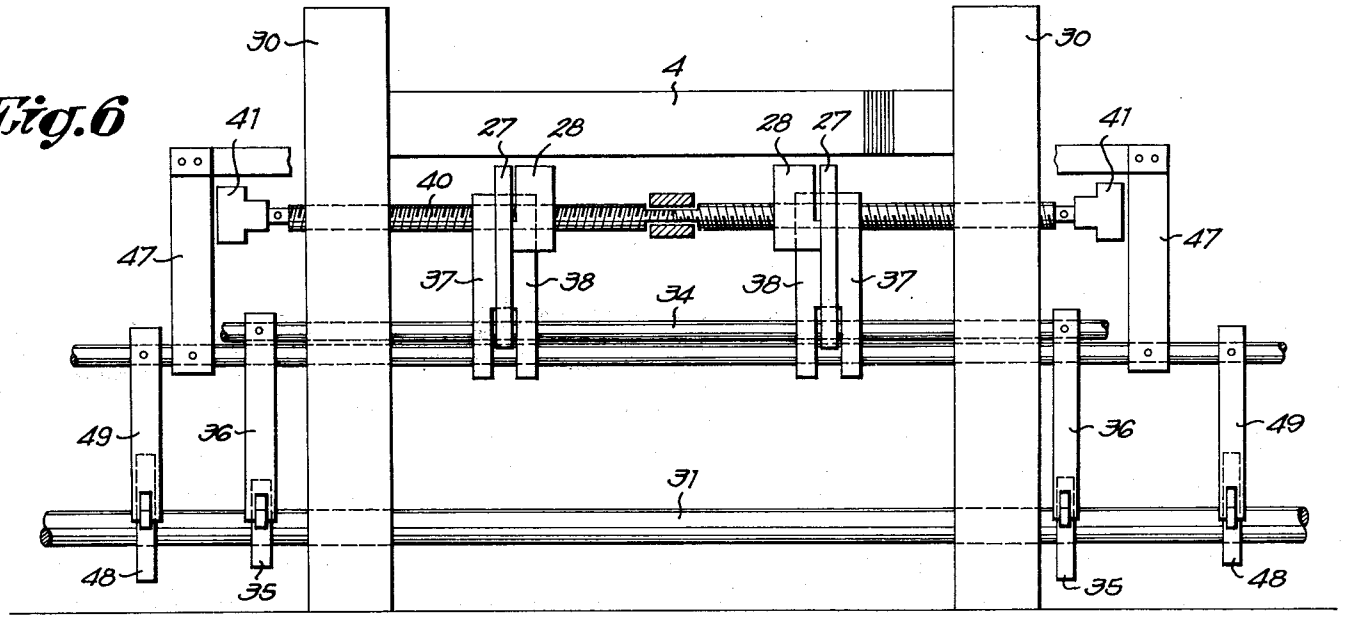
FIG. 6 is a diagrammatic front view of the machine.

The selectors 6 may be controlled in any suitable manner. A preferred device will be described hereafter by way of example. For each needle bed, it comprises two widening fingers 27, two narrowing fingers 28 and a width comb 29. FIGS. 6 and 7 show diagrammatically this control device.

Thus, FIG. 6 shows the posts 30 of the machine, a needle bed 1 and the main cam shaft 31. Each widening finger 27 is mounted at the end of a lever 32 integral with a support 33 slidingly mounted about an axis 34 the angular position of which is controlled by the cams 35 of the cam shaft 31 through the intermediary of levers 36.

Each support 33 is confined between the legs 37 and 38 of a bifurcated nut 39 through which passes a control screw 40 driven by any suitable means, e.g. a step by step motor 41.

The bifurcated ends of the legs 37 and 38 are extending on both sides of an axis 42 to prevent the nut 39 from rotating about the screw 40. Each narrowing finger 28 is carried by a lever 43 pivoting freely at 44 on the said lever 32 and actuated to a stop 45 of the latter by a spring 46. The axis 42 supports the width comb 29 through the intermediary of levers 47 and the angular position thereof is controlled by the cams 48 of the cam shaft 31 through the intermediary of levers 49.

The active portion of the comb 29 consists, according to the angular movement of levers 47, of any of both flat irons 50 and 51.

The fingers 27 and 28 are acting on the heels 21 of the concerned selectors 6, whereas the flat irons 50 and 51 are engaging the heels 20. The finger 27 will have such a width that it may engage only the heel of one or two selectors; the narrowing finger 28 may be substantially wider, e.g. so that it may engage simultaneously ten selectors.

The flat irons 50 and 51 are selected in accordance with the maximum and minimum knitting widths.

An additional selection possibility is provided by equipping the needle bed with a Jacquard type mechanism, e.g. as shown in FIG. 8.

In that case, the rear end of the selectors 6 is dovetailed and each selector is associated with a pin 52 cooperating with a selecting nail 53, said nails 53 being carried by a guide 54.

Under the guide 54 is disposed a drum 55 surrounded, e.g. with a film of plastic material being perforated. Means (not shown) are provided for imparting a reciprocating movement to the drum 54 for selecting the nails 53, and a rotating movement in one direction or the other in order to impart a new selection.

The rear end of each pin 52 has two fingers with unequal lengths 56 and 57, as well as two contact surfaces 58 and 59 for the nail 53 and two contact surfaces 60 and 61 for the leveller 62 driven in synchronism with the shaft 63 of the drum 55.

A rocking-lever 64 with the width of the needle bed 4 is alternatively rotated about and through the shaft 65.

According to the position of a selector 6 at the time of the selection (positions shown in FIGS. 3–5), the rocking lever may meet either the finger 56 or the finger 57 or it may still penetrate the space separating said both fingers without shifting then the pin 52.

The various possibilities are shown in FIGS. 9 to 14.

Figure 9:
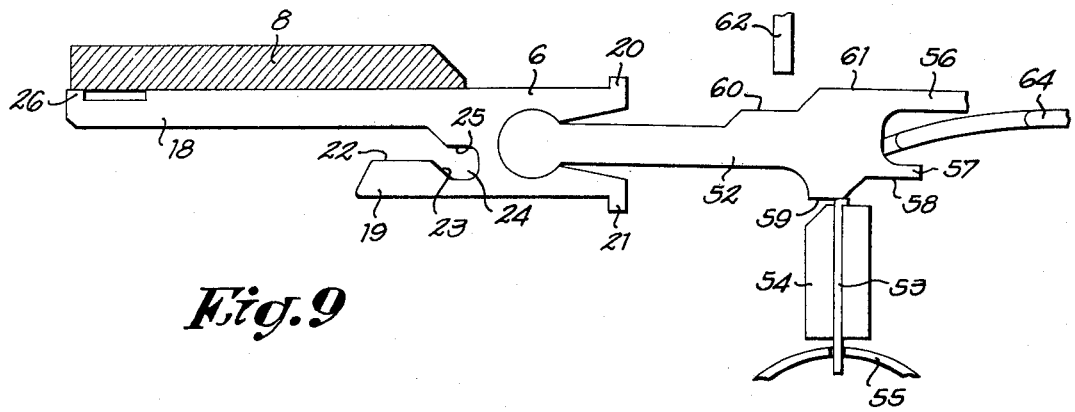
Figure 10:
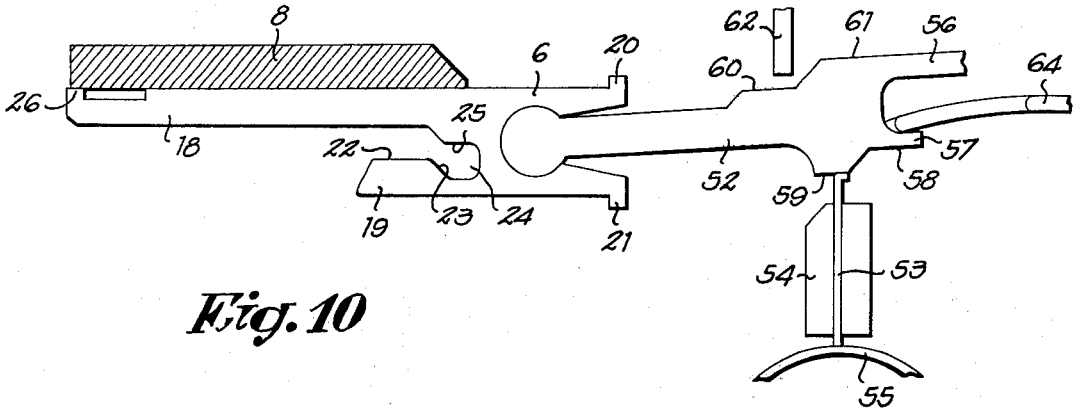
Figure 11:
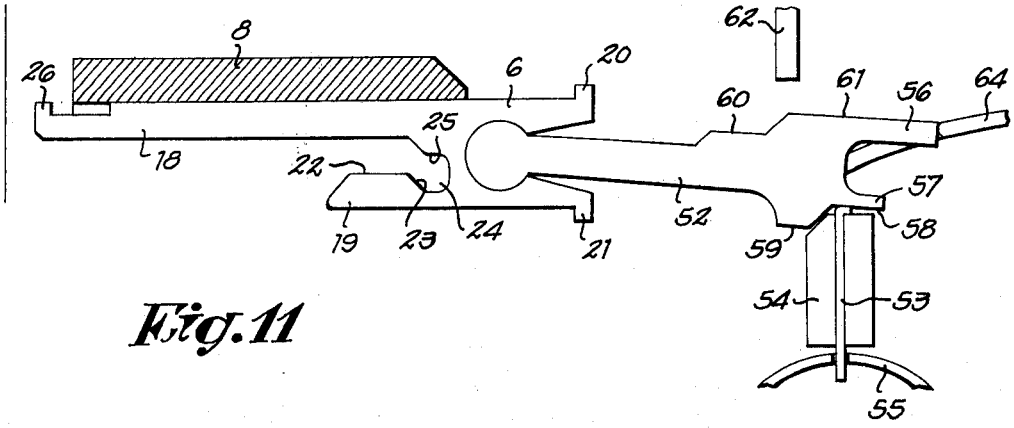
Figure 12:
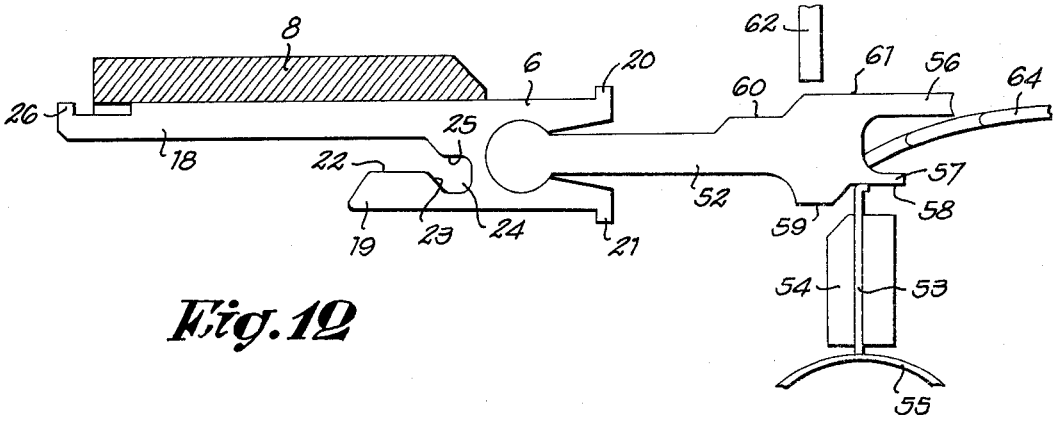
Figure 13:
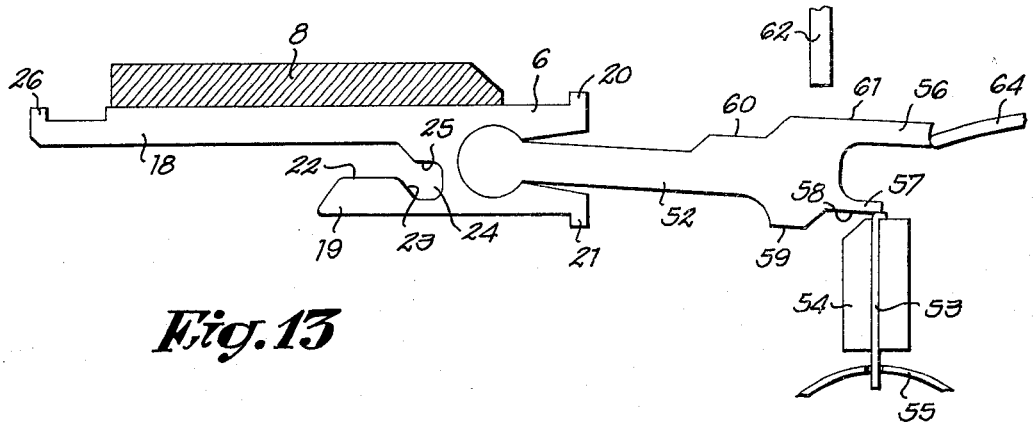
Figure 14:
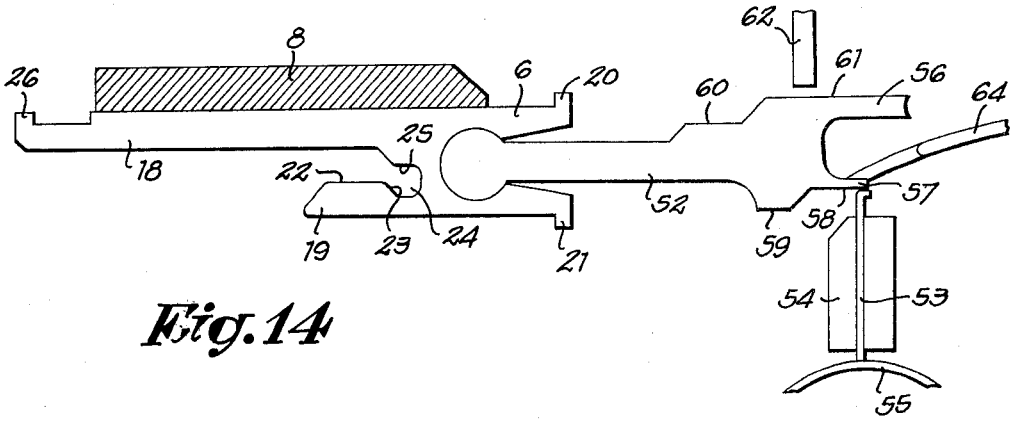
Figure 15:
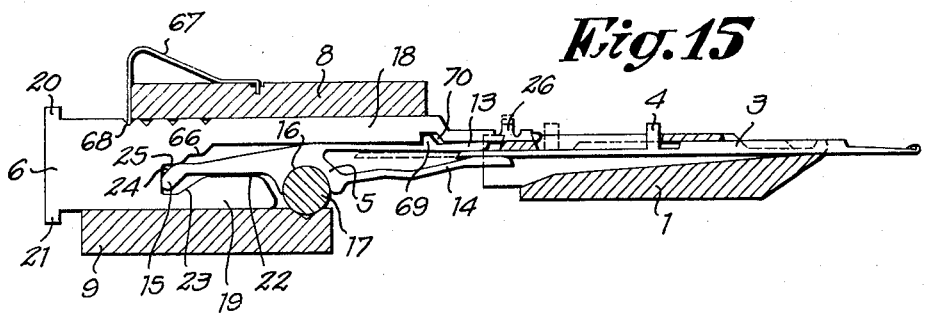

FIGS. 9 and 10 are corresponding to the position of the selector 6 represented in FIG. 4 (selector cancelled), FIGS. 11 and 12 are corresponding to the position represented in FIG. 5 (selector out of action) and FIGS. 13 and 14 are corresponding to the position represented in FIG. 3 (selector in action). The various possibilities are indicated in the following table.

| Selector 6 | Nail 53 against | Jacquard | Effect on the selector 6 |
|---|---|---|---|
| Cancelled (narrowing) FIG. 4 | surface 59 | perforated (FIG. 9) | nihil |
| | | not perforated (FIG. 10) | nihil |
| OUT OF ACTION | surface 58 | peforated (FIG. 11) | pushed to "in action" position |
| FIG. 5 | | not perforated (FIG. 12) | nihil |
| IN ACTION (widening) | | perforated (FIG. 13) | nihil (rocking lever at the end of its travel) |
| FIG. 3 | | not perforated (FIG. 14) | nihil |

It will be observed that the Jacquard pattern has no influence on the narrowing, which is very important in a machine for narrowed panels. Thus, the Jacquard pattern must not be adapted to the slope of the narrowings. In addition, no selvedge canceller must be provided.

It is apparent that a positive Jacquard could be provided instead of the represented negative Jacquard.

In a preferred embodiment, the cam systems are provided with levelling cams acting upon the heels 26 of the selectors 6 to bring them in low position before each novel application of the drum 55; the levellers 62 are forming then only an additional safety means avoiding the necessity of providing one return spring for one pin 52 Of course, the latter are housed in a guide not shown for the clarity of the drawings.

In the embodiment shown in FIGS. 15-18 a fourth selection possibility has been introduced, namely by bringing the needle heels in low position into the path of the cam systems. This is particularly intended for making tubular sweater type knits without Jacquard mecanism.

It should be noted that, in the needle bed according to FIGS. 1 to 14, it could be possible to provide some needles with high heel and other needles with low heel. However, such alternance of different heels should be effected by manually fitting the needle bed. In addition, in such circumstances, during a knitting cycle, the same needle could not be used at one time as a high heel needle and, at another time, as a low heel needle, which is necessary for some knitting operations, more particularly for knitting tubular sweaters.

In the example of FIGS. 15 to 18, the edge of the leg 18 of the selector 6 which faces the leg 19 has two successive projecting flat portions 25 and 66 respectively the first one of which is connected with the base of the leg 19 for completing the said housing 24.

The four characteristic positions of the concerned parts are represented in FIGS. 15 to 18.

Figure 16:
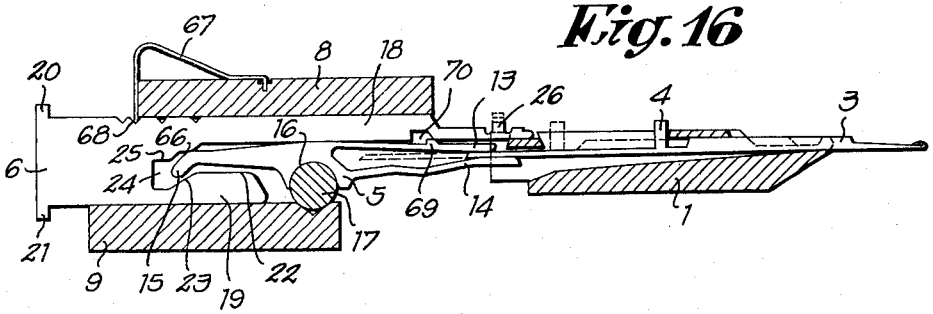

In FIG. 16, the selector 6 is completely sent back forward, the tail 15 of the rocker 5 engages the housing 24, while the heel 4 of the needle 3 projects on the bed of needles 1 and may be subjected to the action of the conventional cam systems (not shown).

As shown in FIG. 16, a slight return movement of the selector 6 brings the end 15 of the rocker 5 against the flat portion 66 owing to the action of ramp 23. The heel 4 of needle 3 is then in position "low heel" respectively half sunk in the bed 1.

Figure 17:
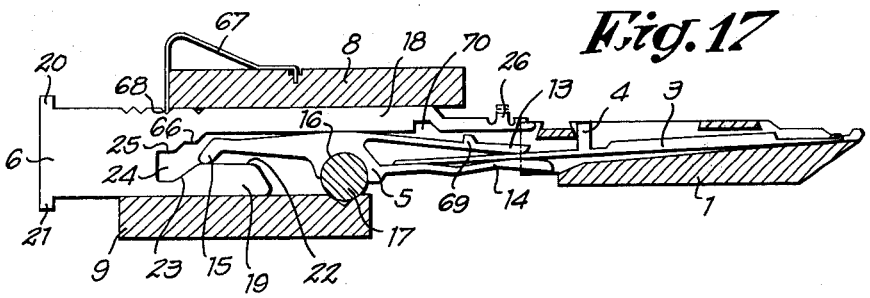

A more important return movement of the selector 6 brings the end 15 of the rocker 5 on the inner edge of the leg 19. The heel 4 of the associated needle is then completely sunk (FIG. 17). The heel 26 of the leg 18 of the selector 6 is then situated within the path of the special selecting cams provided therefor on the cam system.

Figure 18:
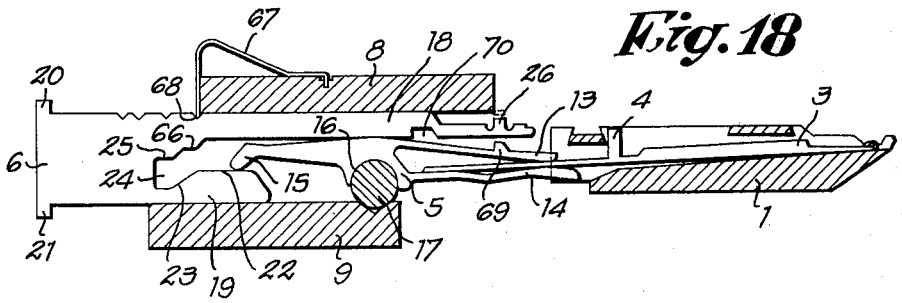

Finally, FIG. 18 shows the maximum returned position of the selector, the heel 4 is sunk and the heel 26 is out of the action of the said special cams. This position is the narrowing position.

The selective shiftings of the selectors 6 may be induced by any suitable means such as the widening and narrowing fingers disclosed in the main Application.

It is possible to provide the heels 26 at three heights, thereby increasing still the selection possibilities.

For the safety of the operation, a positioning spring 67 secured, e.g. to the guide 8, is associated with each selector 6; it cooperates with notches 68 provided in the latter.

In order to obtain a correct localization in height of the heel 4 of each needle, in low position (FIG. 16), the upper leg 13 of the associated rocker 5 may be advantageously provided with a nose 69. A cut-out 70 is then provided in the upper leg of the corresponding selector 6, said cut-out being engaged by the said nose when the device is in the position shown in FIG. 15.

Of course, various modifications may be brought by those skilled in the art to the devices or processes just described only by way of non limitative examples without departing from the scope of the invention.

What I claim is:

1. Improved needle bed for flat knitting machines of the type having needles with heels which may be sunk within the bed, which comprises, for each needle being sunk, an oscillating lever, one bifurcated end of which receives the tail of the associated needle, while the other end is subjected to the action of a control member which may be reciprocated through the intermediary of selecting means;

all said oscillating levers being mounted on a common axis;

the bifurcated end of each oscillating lever consisting of two legs which are initially converging and are then parallel near the free ends thereof, the distance separating the parallel portions being very slightly greater than the height of the tail of the associated needle so that the said parallel portions clamp the said tail when the needle is in sunk position;

the control member comprising, at the needle side, two legs having unequal lengths and, on the other side, a tail having two opposite heels;

the facing edges of the said selector legs being profiled to form a control and locking cam for the said tail of the associated oscillating lever;

the said control and locking cam functions to bring and to maintain the associated oscillating lever in any of three predetermined angular positions of the said control member as a result of a suitable reciprocating movement, said three angular positions of the said oscillating lever corresponding respectively to a high position, a low position and a sunk position of the heel of the associated needle.

2. Needle bed according to claim 1, wherein the said control and locking cam has a ramp on one of the legs and two projecting flat portions on the other leg of the said control member.

3. Needle bed according to claim 1, wherein a nose is provided on the upper leg of the said bifurcated end of the oscillating lever, said nose bearing on the lower edge of the upper leg of the said control member when the heel of the associated needle is in low position.

4. Needle bed according to claim 3, wherein the said nose engages a cut-out of the said upper leg when the heel of the associated needle is in high position.

5. Needle bed according to claim 1, wherein the said selecting means comprise two widening fingers, two narrowing fingers and a width comb.

6. Needle bed according to claim 5, wherein each narrowing finger is associated with a widening finger the so constituting finger pairs being each provided with their own support.

7. Needle bed according to claim 6, wherein each of the said supports is slidably mounted about an axis and is confined between the legs of a bifurcated nut through which passes a screw the rotation of which causes the shifting of the said nut or the said support respectively.

8. Needle bed according to claim 7, wherein the angular position of the said support may be modified by a corresponding rotation of the said sliding axis, said rotation being controlled from the cams provided therefor and disposed on the conventional main cam shaft of the machine.

9. Needle bed according to claim 5, wherein the said width comb is provided with interchangeable flat irons the width of which may be also adjusted.

10. Needle bed according to claim 9, wherein the said width comb is carried by levers blocked on an axis which may be angularly shifted from the cams provided therefor on the conventional main cam shaft of the machine.

11. Needle bed according to claim 10, wherein the said axis of the width comb extends between the bifurcated ends of the legs of the said nuts, thereby preventing the latter from rotating about the screws passing therethrough.

12. Needle bed according to claim 1, wherein the said selecting means comprise additionally a Jacquard type device to determine the angular position of pins, each connected to one of the said selectors, thereby bringing selectively the said pins in or out the path of an oscillating lever.

13. Needle bed according to claim 12, wherein each pin has, at one end, a round head engaging a corresponding recess of the tail of the associated selector and, at the other end, two mutually parallel fingers having different lengths.

14. Needle bed according to claim 13, wherein the lower edge of each pin and the lower edge of the lower finger thereof are two pressure surfaces situated at different levels and on which may act a nail controlled by a Jacquard drum, one nail being provided for each pin.

* * * * *